US005256083A

United States Patent [19]

Yamamoto

[11] Patent Number: 5,256,083

[45] Date of Patent: Oct. 26, 1993

[54] ELECTRICAL CONNECTOR

[75] Inventor: Takayuki Yamamoto, Shizuoka, Japan

[73] Assignee: Yazaki Corporation, Tokyo, Japan

[21] Appl. No.: 960,495

[22] Filed: Oct. 13, 1992

[30] Foreign Application Priority Data

Oct. 28, 1991 [JP] Japan ..... 3-281383

[51] Int. Cl.[5] ..... H01R 13/40

[52] U.S. Cl. ..... 439/595; 439/598; 439/752

[58] Field of Search ..... 439/595, 752, 597-599

[56] References Cited

U.S. PATENT DOCUMENTS

| | | | |
|---|---|---|---|
| 4,758,182 | 7/1988 | Anbo et al. | 439/598 |
| 4,946,399 | 8/1990 | Kawashima | 439/752 |
| 4,975,082 | 12/1990 | Nagasaka et al. | 439/598 |
| 5,033,980 | 7/1991 | Watanabe et al. | 439/752 |
| 5,088,938 | 2/1992 | Murakami et al. . | |
| 5,176,537 | 1/1993 | Samejuma et al. | 439/595 |

*Primary Examiner*—Paula A. Bradley
*Attorney, Agent, or Firm*—Armstrong, Westerman, Hattori, McLeland & Naughton

[57] ABSTRACT

This invention relates to an electrical connector having a terminal extracting block for extracting terminals from terminal accommodating cavities and for fixing the terminals in position. The electrical connector according to the present invention comprising: a housing having terminal accommodating cavities and a resilient locking arm for preventing a terminal accommodated in the terminal accommodating cavities each from slipping off backward, the terminal accommodating cavities each having opposing inner walls, the resilient locking arm extruding from one of the inner opposing walls toward a front open end of the terminal accommodating cavities each with a vacant space being formed between the one of the opposing walls and the resilient locking arm; and a terminal extracting block having arm disconnecting pieces, the arm disconnecting pieces each having a tapered arm disconnecting face at a free end thereof, wherein the terminal extracting block moves from a locking position to an arm disconnecting position to allow the arm disconnecting face of the arm disconnecting piece to slidably contact a tip of the resilient locking arm, which causes the resilient locking arm to bend toward the one inner wall so that the terminal is disconnected from the resilient locking arm.

6 Claims, 10 Drawing Sheets

ELECTRICAL CONNECTOR

BACKGROUND OF THE INVENTION

1. Field of the Invention

This invention relates to an electrical connector for connecting electrical wires and equipment to each other and more particularly to an electrical connector having a terminal extracting block for extracting terminals from terminal accommodating cavities and for fixing the terminals in position.

2. Description of the Prior Art

A common practice of locking terminals in a terminal accommodating cavity of a connector involves, as shown in FIG. 11, providing a resilient locking arm b on an inner wall a1 of the terminal accommodating cavity a and engaging a locking projection b1 of the locking arm b with a locking hole c2 of the electrical contact portion c1 of a terminal c to prevent the terminal c from being slipped off backward. In order to improve terminal sustaining force, it has been proposed that a spacer d (deflection preventing piece), which is indicated by a two-dot chain line, be inserted into a vacant space v between the locking arm b and the inner wall a1, thereby prevents the locking arm b from being deflected in the direction indicated by an arrow p.

The terminal c is extracted with a terminal extracting jib e by disconnecting the resilient locking arm from the terminal c. In other words, an extracting pin e1 of the terminal extracting jig e, which is made of metal, is inserted between the terminal c and the resilient locking arm b, and a tip of the extracting pin e1 is abutted to a concave portion of the locking arm b and is prized to disconnect the arm b from the terminal c by urging the arm toward the inner wall a1. When the spacer d is mounted, as illustrated in FIG. 12A, after the spacer d is extracted to obtain a preliminary locking position, the extracting pin e1 is inserted from a narrow opening between the spacer d and the electrical contact portion c1 and the tip thereof is abutted to the concave portion b2 of the resilient locking arm b in the same manner as described above to extract the terminal c as shown in FIG. 12B.

In the conventional terminal extracting method described above, however, it is required to prepare a tool such as the terminal extracting jig to directly prize the electrical contact portion of the terminal and the resilient locking arm, which may cause the electrical contact portion and the terminal to be damaged. Further, when the spacer is used, it is worrisome to move the spacer to the preliminary locking position. In this case, since it is difficult to observe in the terminal accommodating cavity, excessive force may be applied to the tool, which may cause a serious damage to the resilient locking arm.

SUMMARY OF THE INVENTION

The present invention has been made to eliminate the problems described above and the object thereof is to provide an electric connector in which a tool is not required to extract the terminals; the work for extracting the terminal is carried out with ease; and the terminal and the resilient locking arm are prevented from being damaged.

An electrical connector according to one embodiment of the present invention comprising: a housing having terminal accommodating cavities and a resilient locking arm for preventing a terminal accommodated in the terminal accommodating cavities each from slipping off backward, the terminal accommodating cavities each having opposing inner walls, the resilient locking arm extruding from one of the inner opposing walls toward a front open end of the terminal accommodating cavities each with a vacant space being formed between the one of the opposing walls and the resilient locking arm; and a terminal extracting block having arm disconnecting pieces, the arm disconnecting pieces each having a tapered arm disconnecting face at a free end thereof, wherein the terminal extracting block moves from a locking position to an arm disconnecting position to allow the arm disconnecting face of the arm disconnecting piece to slidably contact a tip of the resilient locking arm, which causes the resilient locking arm to bend toward the one inner wall so that the terminal is disconnected from the resilient locking arm.

An electrical connector according to another embodiment of the present invention comprising: a housing having terminal accommodating cavities and a resilient locking arm for preventing a terminal accommodated in the terminal accommodating cavities each from slipping off backward, the terminal accommodating cavities each having opposing inner walls, the resilient locking arm extruding from one of the opposing inner walls toward a front open end of the terminal accommodating cavities each with a vacant space being formed between the one of the opposing walls and the resilient locking arm; and a terminal extracting block having arm disconnecting pieces, the arm disconnecting pieces each having a tapered arm disconnecting face at a free end thereof, wherein the terminal extracting block moves from a preliminary locking position to an arm disconnecting position to allow the arm disconnecting face of the arm disconnecting piece to slidably contact a tip of the resilient locking arm, which causes the resilient locking arm to bend toward the one inner wall so that the terminal is disconnected from the resilient locking arm; and the terminal extracting block moves from the preliminary locking condition to a full locking condition to allow the arm disconnecting arm to be inserted into the vacant space between the inner wall of the terminal accommodating cavities each and the resilient locking arm, which prevents the resilient locking arm from bending toward the inner wall.

In the first embodiment according to the present invention, the connector is provided with the terminal extracting block made of synthetic resin having the arm disconnecting pieces to disconnect the terminals from the resilient locking arms in the terminal accommodating cavities. Therefore, it is unnecessary to use the terminal extracting jig, which is used in a conventional connector, preventing the terminals and the resilient locking arms from being damaged. Further, in the second embodiment of the present invention, the arm disconnecting pieces of the terminal extracting block is positioned in the vacant space between the resilient locking arm and one of the inner walls of the terminal accommodating cavities to at the full locking condition to prevent the resilient locking arm from bending toward the other inner wall, which improves the force for sustaining the terminals in the cavities besides the function of extraction of the terminals.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
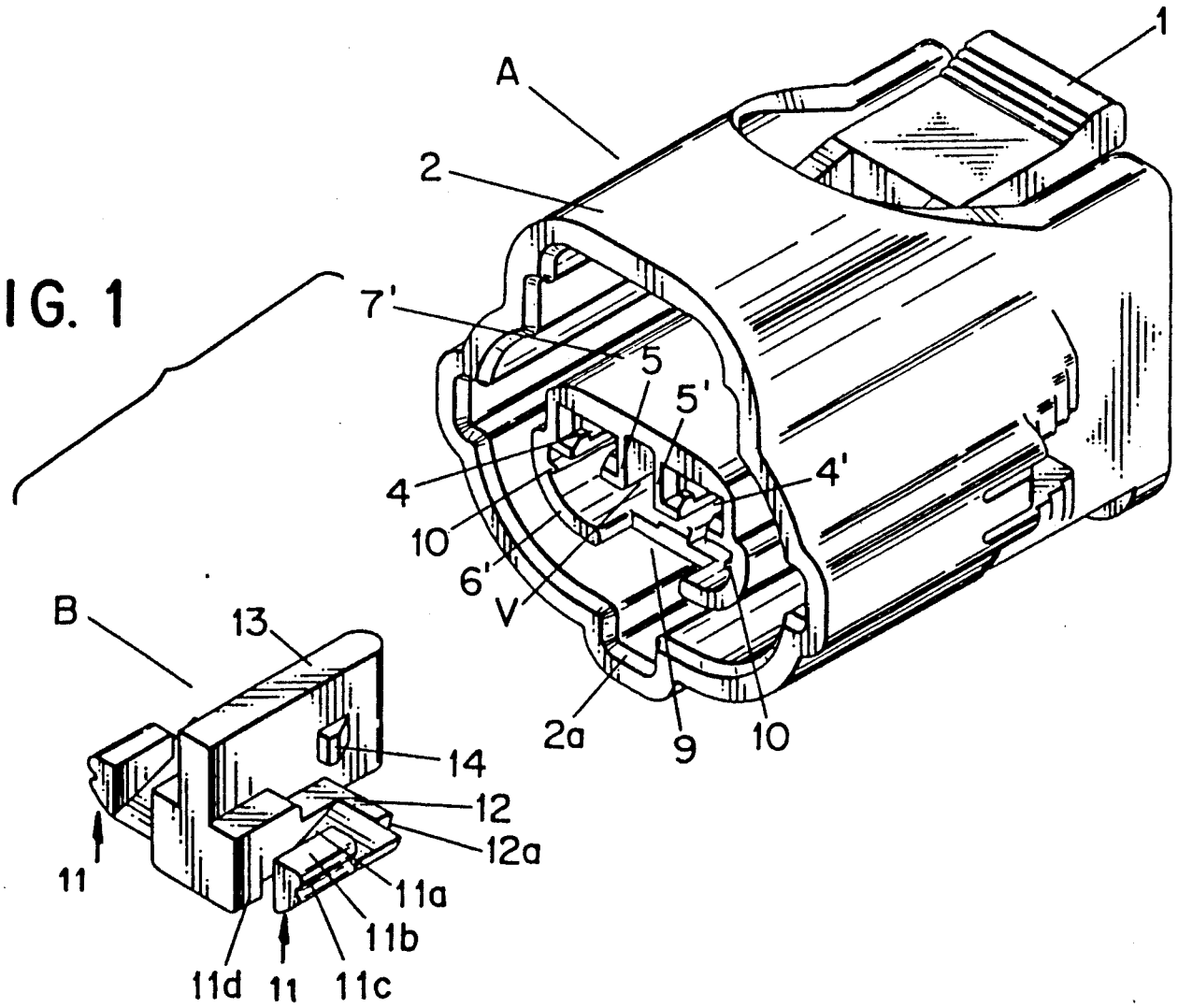
FIG. 1 is a perspective view of a male connector housing and a terminal extracting block, which are separated from each other, according to one embodiment of the present invention.
Figure 2:
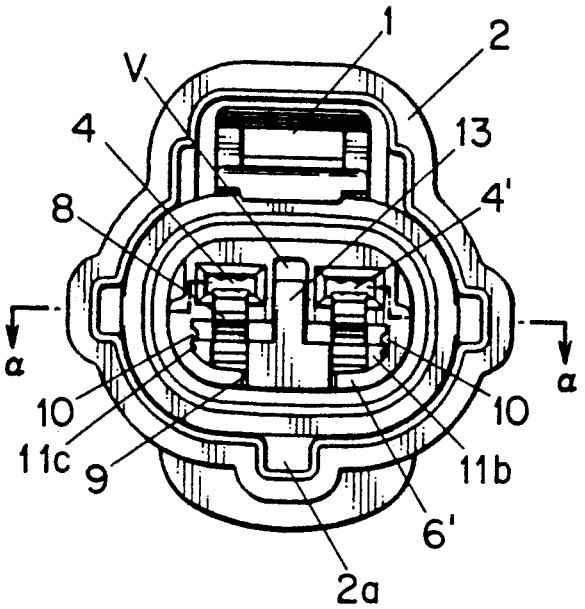
FIG. 2 is a front view of a connector to which the terminal extracting block of FIG. 1 is locked.

Referring to FIG. 1, reference symbol A represents a male connector housing (hereinafter called as "housing") made of synthetic resin, and B a terminal extracting block made of synthetic resin which is inserted into the housing from a front portion thereof. The male connector housing A is to be coupled with a counterpart female connector housing not shown and has on its outer periphery a locking arm 1 that engages the mating female connector housing, and a waterproofing hood 2. A water proofing packing 3 (see FIG. 3) is fitted in a depth of a gap between the outer periphery and the waterproofing hood 2.

Provided in the connector housing A are a pair of laterally arranged terminal accommodating cavities 4 and 4' of which both ends are opened. The terminal accommodating cavities are separated by opposing side walls 5 and 5', between which a gap V is provided.

Figure 4A:
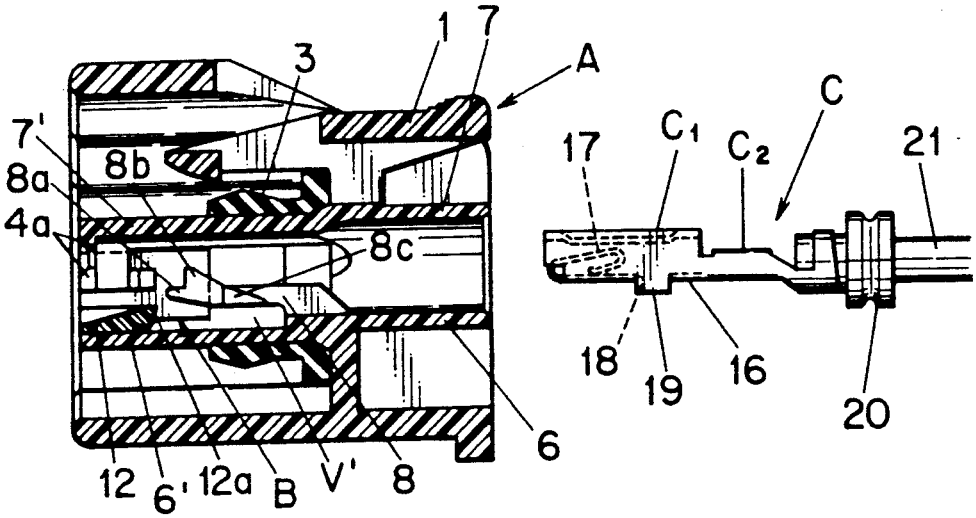
FIGS. 4A to 4C are cross sections showing a process for inserting a female terminal into the housing with the terminal extracting block B and engaging the terminal with the housing.
Figure 4B:
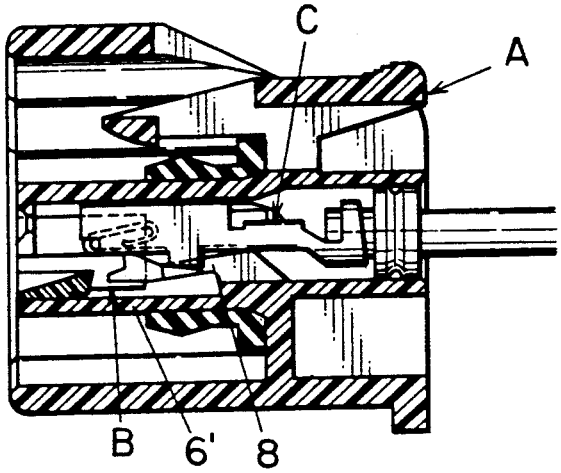

The terminal accommodating cavities 4 and 4' each has, as shown in FIG. 4A, opposing bottom and upper walls 6 and 7. A front half of the bottom wall 6 is formed as a portion 6' of the bottom wall which slightly outwardly enlarged in diameter. A front half of the upper wall 7 is formed as a portion 7' of the upper wall which slight inwardly decreased in diameter. On a portion of the bottom wall 6, which opposes the center of the terminal accommodating cavities 4 (4'), is provided a resilient locking arm 8 extending toward front opening ends of the terminal accommodating cavities. The resilient locking arm 8 is formed in such a manner that a vacant space V' is provided between the bottom wall 6' and the resilient locking arm 8. At a free end of the locking arm 8 is formed a locking projection 8*b* through a projecting terminal holder 8*a*. At both sides of a rear portion of the locking arm 8 are formed triangular locking claws 8*c* which project therefrom. On a wall opposite to the terminal holder 8*a* is provided a tapered face 8*a'* (see FIG. 5C) in such a manner as to be narrower as approaching the end of the wall. The locking projection 8*b* and the locking claw 8*c* engage a locking hole 18 and a locking piece 19 respectively to prevent the terminal from being slipped off rearward.

Referring again to FIG. 1, at the center of the front half of the bottom wall 6' is provided a notch 9 and on both sides of the inner wall of the bottom wall 6' is formed positioning projections 10 for the terminal extracting block B in the direction that the connector is engaged. In the figure, reference symbol 2*a* represents a guide channel for the female connector housing, which prevents the female connector housing from being connected upside down.

The terminal extracting block B has arm disconnecting pieces 12 at right and left front portions thereof for the terminal accommodating cavities 4 and 4' respectively and a locking plate 13 at the center thereof and connecting plates 11, FIG. 1, to the rear of the connecting pieces 12. On both sides of the connecting plate 11 are formed insertion guiding portions 11*b* having wing portions 11*a*. On an outer periphery of the guide portions 11*b* each is formed a channel 11*c* which engages the positioning projections 10. At a rear end of a lower face the connecting plate 11 is formed a hitching piece 11*d* for disengaging the locking. The arm disconnecting pieces are used for disconnecting the female terminals C from the resilient locking arms 8 and on tip portions thereof are formed tapered arm disconnecting faces. The locking plate 13 crosses the arm disconnecting pieces 12 at right angles and is formed slightly longer than the arm disconnecting pieces 12. A first locking projection 14 is attached to a side wall of the connecting plate 14. Further, the hitching piece 11*d* engages the notch 9 to work as a stopper for regulating the depth that the terminal extracting block B is inserted into the housing A.

The female terminal C has, as shown in FIG. 4A, a known structure in which the electrical contact portion C1 is formed at a front portion of a base portion 16 and a wire connecting portion C2 at a rear portion thereof. Reference numeral 17 shows a resilient contact piece and 18 an engagement hole, 19 locking pieces, 20 a water-proofing rubber packing, 21 a wire.

Figure 3:
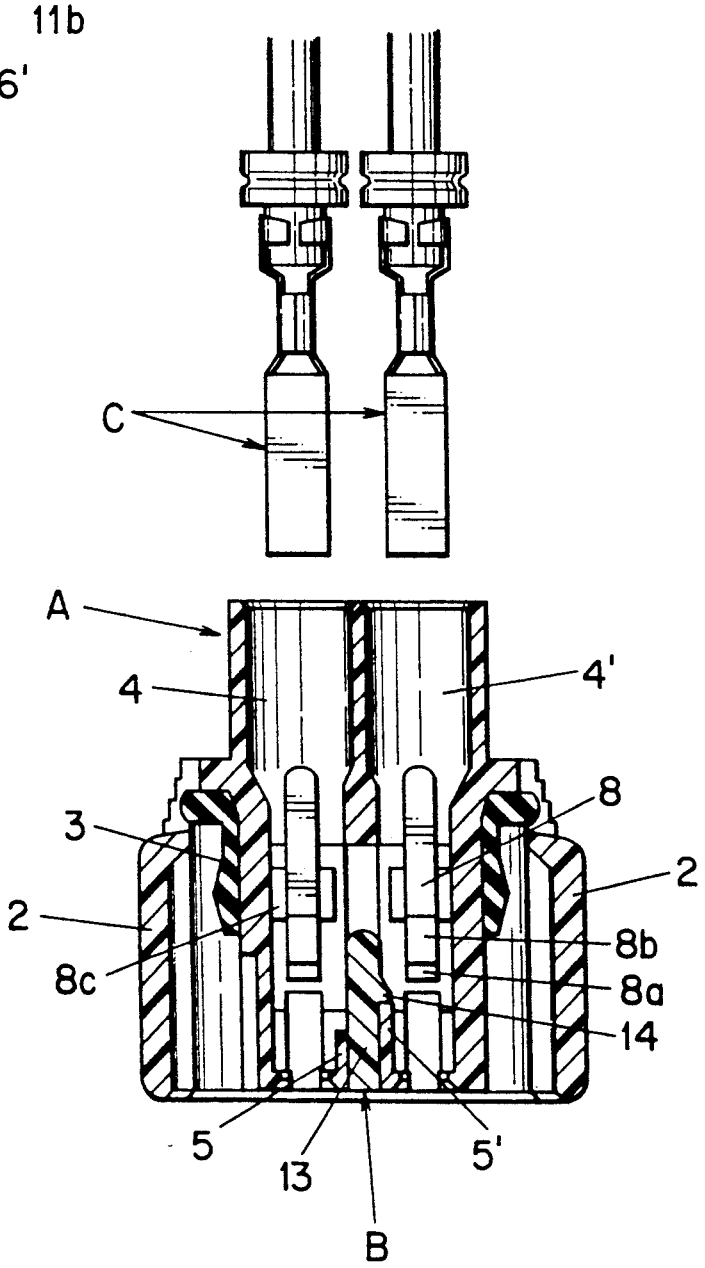
FIG. 3 is a cross-sectional view of connector taken along the line $\alpha$—$\alpha$ of FIG. 2.

Next, the method of operating the terminal extracting block B will be explained with reference to FIGS. 1 to 4C. At first, the terminal extracting block B is inserted from front open ends of the terminal accommodating cavities 4 and 4' and is locked there. That is, an end of the locking plate 13 is inserted into a vacant space V between the terminal accommodating cavities 4 and 4' and the insertion guide portions 11*b* at both ends of the locking plate 13*b* are positioned under the both guide projections 10 of the bottom wall 6' (see FIG. 2). Under this condition, when the terminal extracting block B is pushed with light force, the first locking projection 14 of the locking plate 13, which proceeds into the vacant space V between the side walls 5 and 5', crosses over a rear end face of one of the side walls 5' as illustrated in FIG. 3, which prevents the locking plate 13 from being slipped off rearward. Further, the engagement of the hitching piece 11*d* with the notch 9 prevents the locking plate 13 from being excessively inserted. As a result, the locking plate is maintained in locking condition in which back and forth movement of the locking plated is regulated.

Under the locked state, as illustrated in FIG. 4A, the arm disconnecting piece 12 is in contact with the bottom wall 6', and the tip thereof is slightly apart from the tip of the resilient locking arm 8 and opposes the vacant space V' of the locking arm 8.

Figure 4C:
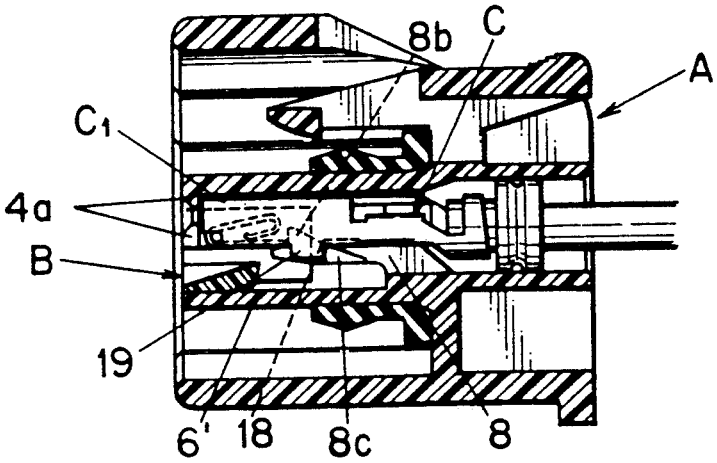

On inserting the female terminal C from a rear opening end of the terminal accomodating cavity 4 or 4', as illustrated in 4B, the resilient locking arm 8 once bends toward the bottom wall 6' due to the insertion of the female terminal C and further insertion of the terminal C causes a tip of the electrical contact portion C1 to abut a stopper 4*a* at the front portion of the terminal accommodating cavities, as shown in FIG. 4C, which prevents the terminal from being sipped off forward. At the same time, the resilient locking arm 8 return to the original position due to its resiliency, so that a locking projection 8*b* of the locking arm 8 engages the locking hole 18. Further, the locking claws 18*c* engage the locking pieces 19 at both ends of the locking arm 8, which doubly prevents the female terminal C from being slipped off rearward.

Next, the method of extracting terminals by using the terminal extracting block B will be explained with reference to FIGS. 5A to 5C.

Figure 5A:
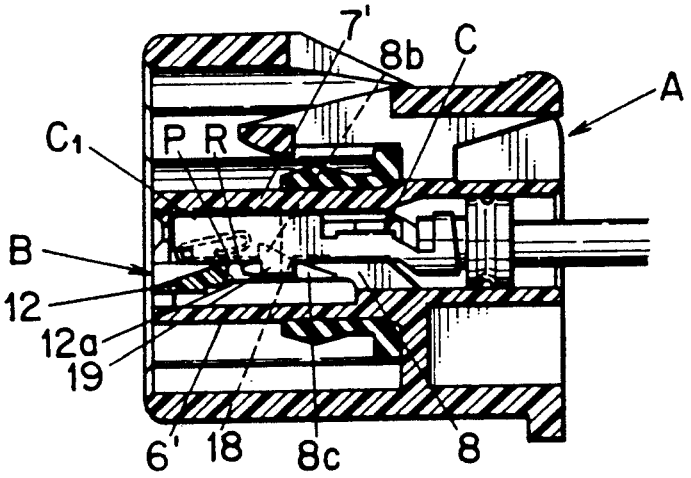
FIGS. 5A to 5C are cross sections showing a process for extracting the female terminal from the housing by the terminal extracting block B.

FIG. 5A shows a condition in which the terminal extracting block B is slightly lifted under the condition that the female terminal C is locked as shown in FIG. 4C. In other words, FIG. 5A shows an arm disconnecting position in which the terminal extracting block B is moved toward the upper wall 7', and a point P which shows a tip of the arm disconnecting piece 12 is moved higher than a point R which shows a tip of the resilient locking arm 8, and the point R is opposed to the middle of the tapered arm disconnecting face 12*a* of the arm disconnecting piece 12. The arm disconnecting position is obtained by lifting the terminal extracting block B under the condition illustrated in FIG. 2. In this state, the positioning projections 10 engage the positioning channels 11 so that the terminal extracting block B is retained at the arm disconnecting position.

Figure 5B:
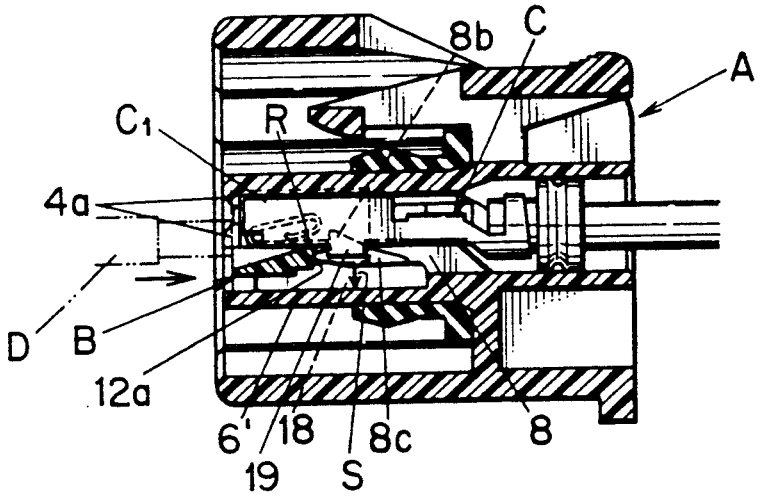

FIG. 5B shows a half way of the process for disconnecting the female terminal from the resilient locking arm 8. That is, pushing the terminal extracting block B by a driver D or a finger causes the point R of the resilient locking arm 8 to slidably move on the arm disconnecting face 12*a*, which permits the arm 8 to bend toward the bottom wall 6'. As a result, the engagement between the locking projections 8*b* and the locking holes 18, and the locking pieces 19 and the locking claws 8*c* are released.

Figure 5C:
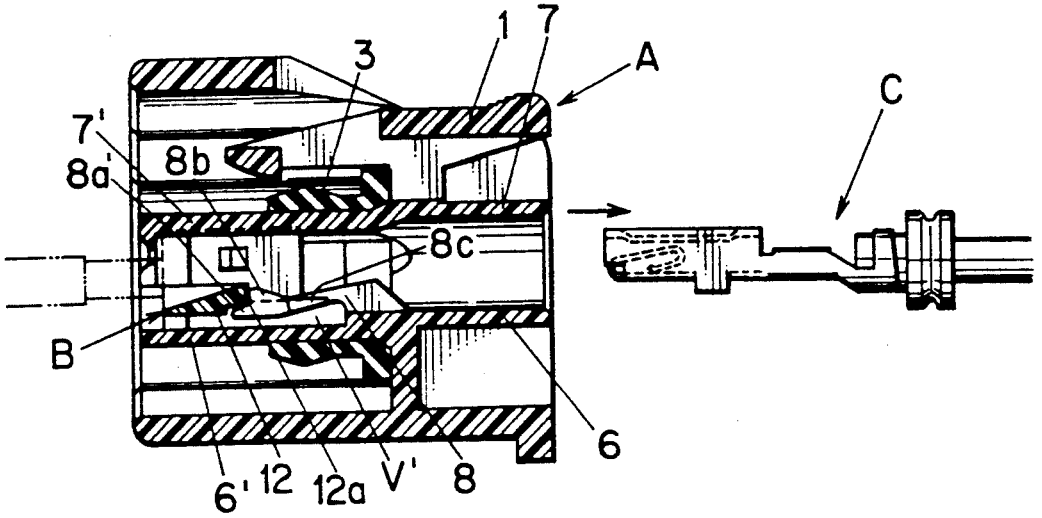

FIG. 5C shows a condition in which the resilient locking arm 8 fully bends in the vacant space V' to release the engagement with the female terminal C and then the terminal C is extracted from a rear portion of the housing. When the terminal extracting block B is slightly drawn under the condition described above so as to be moved downward, the state shown in 4A is again obtained, which permits the terminal C to be used repeatedly.

FIGS. 6 to 10 show an electrical connector according to another embodiment of the present invention. In this embodiment, a terminal extracting block B' is designed so as to have a function as a terminal holder also.

Figure 6:
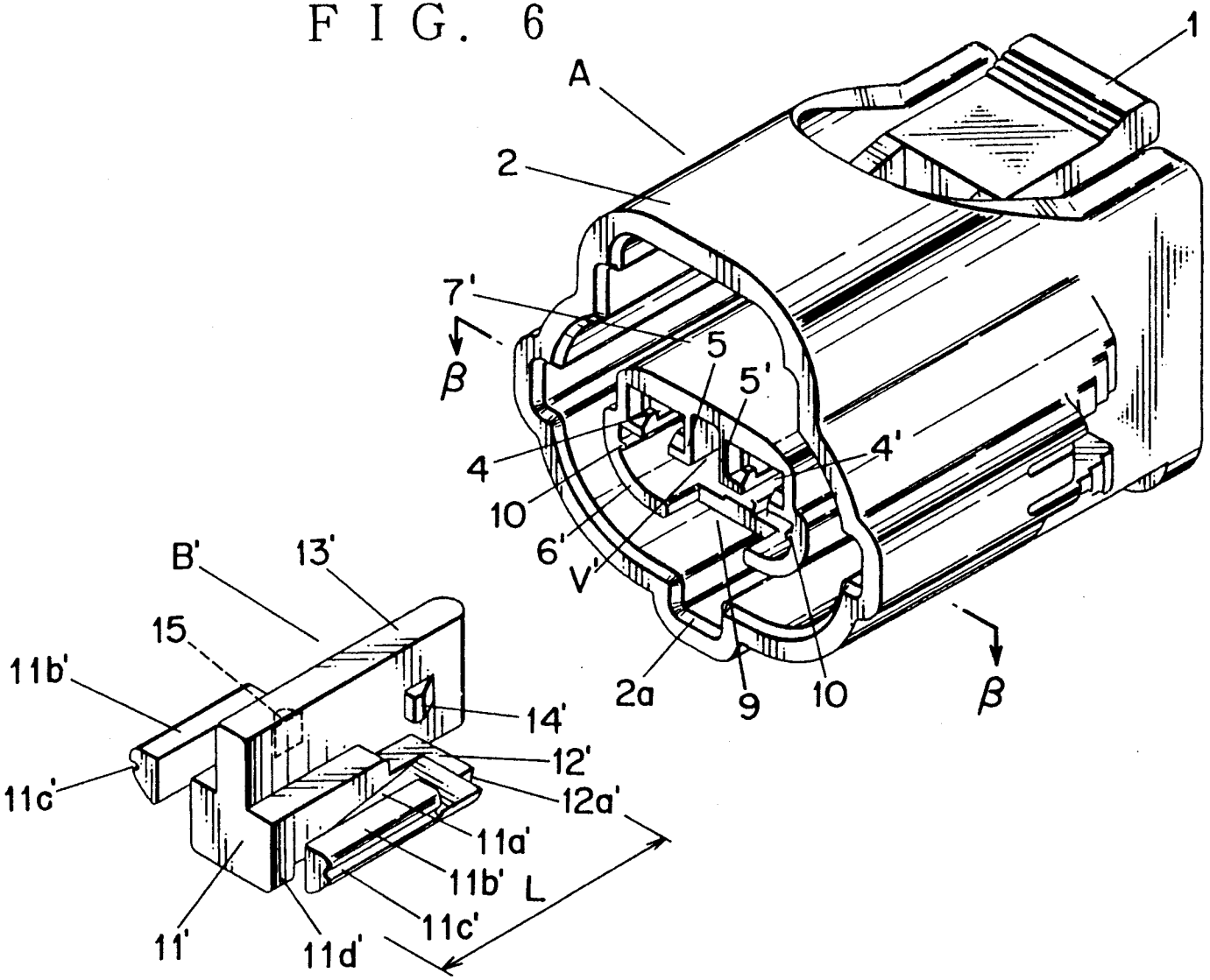
FIG. 6 is a perspective view of the male connector housing and the terminal extracting block, which are separated from each other, according to another embodiment of the present invention.

In FIG. 6, a housing A is the same as that of FIG. 1. The difference between the terminal extracting block B' and the terminal extracting block B is only in that the terminal extracting block B' is formed to have a full length longer than that of the terminal extracting block B, and the terminal extracting block B' is provided with a first locking projection 14' on a front portion of a side of a locking plate 13', and a second locking projection 15 on a rear portion of the other side of the locking plate 13'. The full length L is determined in such a manner that when the terminal extracting block B' is moved from a preliminary locking state to a full locking state with respect to the housing A, an arm disconnecting piece 12' proceeds into a vacant space V' between terminal accommodating cavities 4 and 4' to prevent the resilient locking arm 8 from bending toward the bottom wall 6' and to increase force for maintaining the engagement of the terminal by the arm 8 as described below.

That is, the terminal extracting block B' is provided with the arm disconnecting piece 12' for the terminal accommodating cavities 4 and 4' each at right and left front portions each of a connecting plate 11' in the same manner as described above. Further, a locking plate 13' is attached to the center portion of the terminal extracting block B'. Reference symbol 11*a'* are thin portions, and 11*b'* insertion guide portions, 11*c'* guide channels, 11*d'* a hitching piece. At an end of the arm disconnecting pieces each is formed a tapered arm disconnecting face 12*a'*. On both faces of the locking plate 13' are mounted the first locking projection 14' and the second locking projection 15, of which positions do not overlap each other through the locking plate 13' as described above.

Next, a function of the terminal to increase the retaining force by the terminal extracting block B' will be explained with reference to FIGS. 6 to 9.

Figure 7:
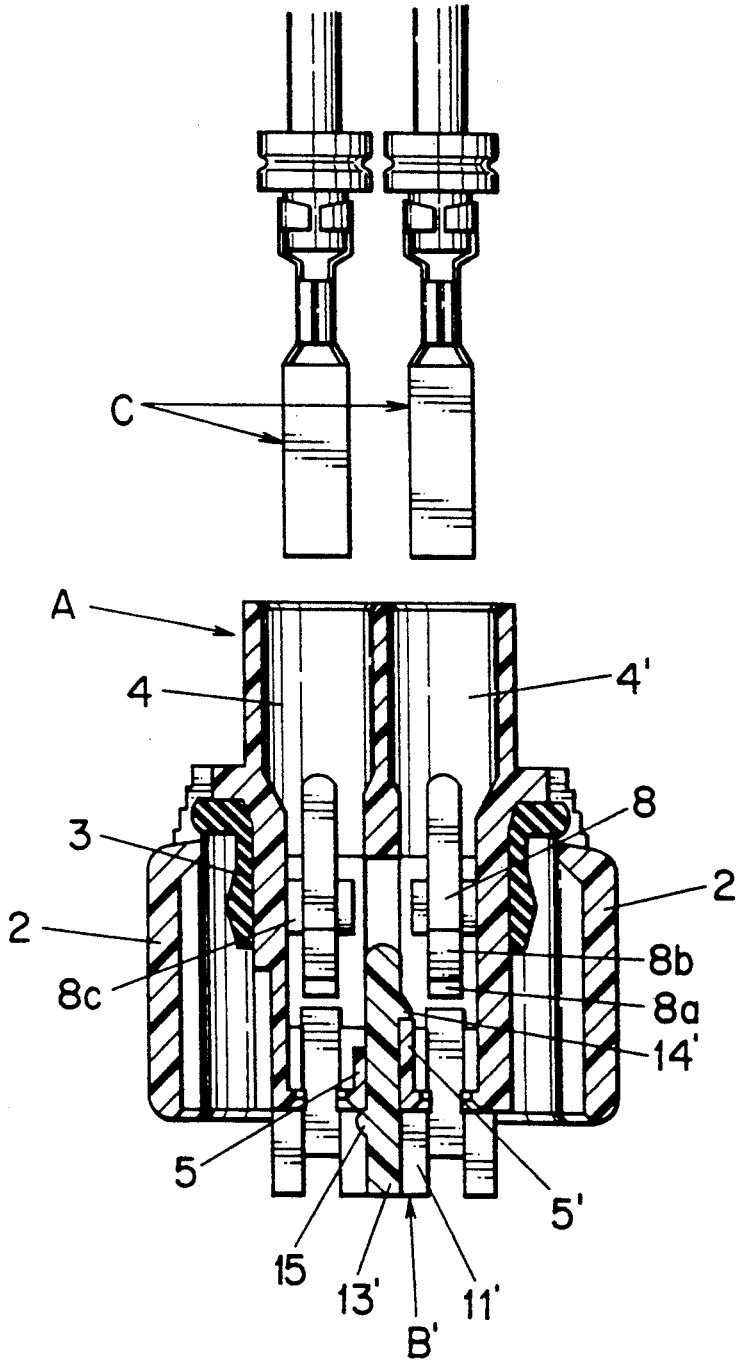
FIG. 7 is a cross-sectional view of the connector taken along the line $\beta$—$\beta$ of FIG. 6, which shows that the terminal extracting block is preliminarily locked.

At first, the terminal extracting block B' is inserted from the front open ends of the terminal accommodating cavities 4 and 4' to achieve preliminary locking state. In other words, an end of the locking plate 13' is inserted into the vacant space V' between the terminal accommodating cavities 4 and 4' to position the insertion guide portions 11*b'* at both sides of the connecting plate 11' under the locking projections 10 at both sides of the bottom wall 6' (see FIG. 2). Under the condition, on pushing the terminal extracting block B', the locking plate 13' proceeds into the vacant space V' between side walls 5 and 5'. Further, the second locking projection 15 abuts a front end face of one of the side wall 5, as illustrated in FIG. 7, and the first locking projection 14' simultaneously crosses over a rear end face of the other side wall 5' to obtain preliminary locking state in which back and forth movement of the terminal extracting block B is restricted.

Figure 8A:
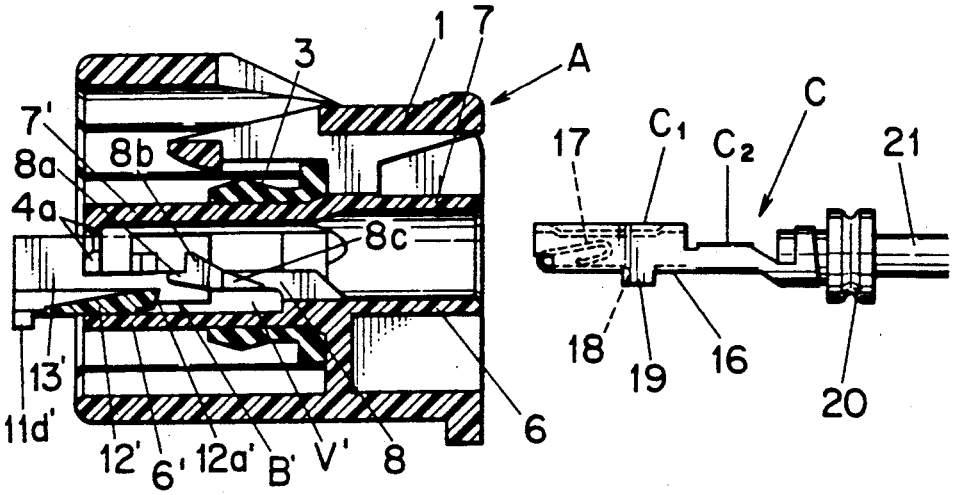
FIGS. 8A to 8C are laterally cross-sectional views showing a process in which the terminal extracting block is moved from the preliminary locking condition to a final locking condition.

In the preliminary locking state, as shown in FIG. 8A, the arm disconnecting piece 12' is in contact with the bottom wall 6' and an end portion thereof opposes the vacant space V' through which the end portion proceeds. That is, when the terminal extracting block B' is further pushed forward, the disconnecting pieces 12' are still positioned where they are able to proceed into the vacant space V'. Then, inserting the female terminal C permits the terminal to be doubly locked in the same manner as described in FIG. 4C (see FIG. 8B).

Figure 8B:
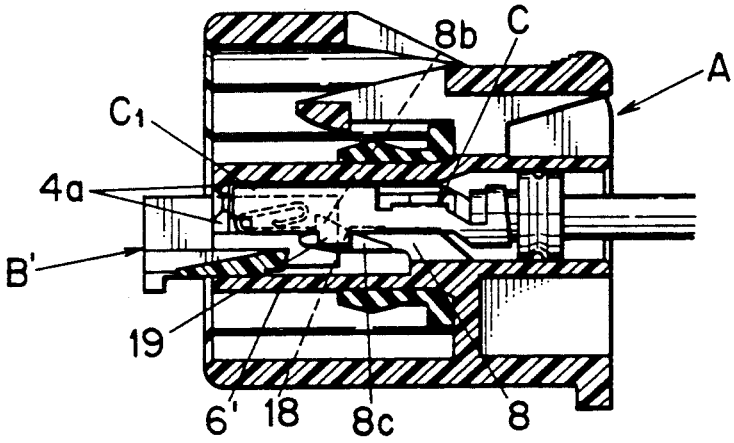
Figure 8C:
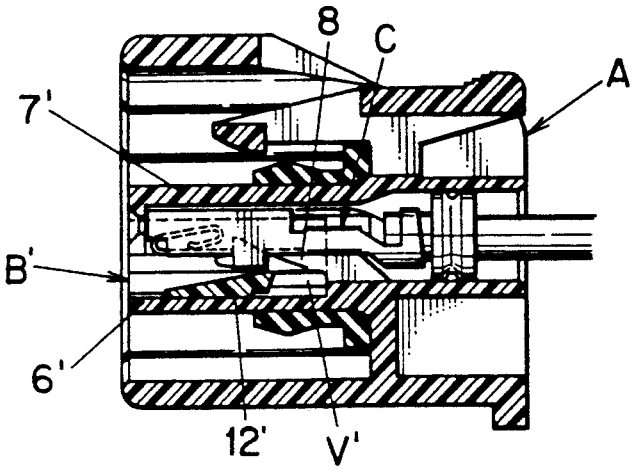
Figure 9:
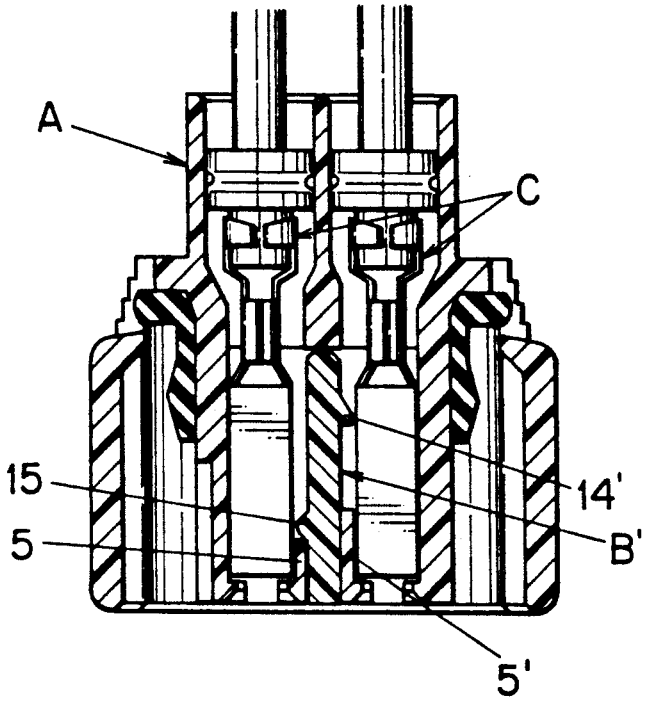
FIG. 9 is a cross sectional view taken along the line $\beta$—$\beta$ of the FIG. 6, which shows that the female terminal is engaged and the terminal extracting block is fully locked.
Figure 11:
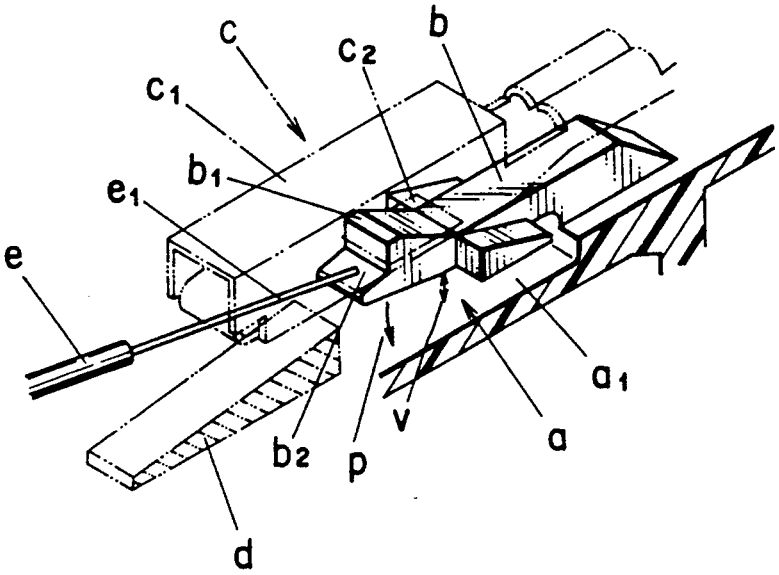
FIG. 11 PRIOR ART
FIG. 11 is a perspective view of a primary portion of the connector for explaining a conventional method of extracting terminals.

Then, on pressing the terminal extracting block B' strongly, as described in FIG. 8C, the arm disconnecting piece 12' proceeds into the vacant space V' to prevent the resilient locking arm 8 from bending toward the bottom face 6' and to push an electrical contact portion of the female terminal C toward an upper wall 7', resulting in increased terminal retaining force. In this case, the second locking projection 15 is engaged with the rear end face of the side wall 5 as illustrated in FIG. 9, permitting the terminal extracting block B' to be fully locked.

In FIG. 8B, if the insertion of the terminal C is incomplete, the resilient locking arm 8 bends toward the bottom wall 6' to narrow the vacant space V'. As a result, end portions of the arm disconnecting pieces 12' oppose and abut the locking projections 8*b* of the arm 8, which makes it impossible to further insert the terminal C. Therefore, incomplete insertion of the terminal C is to be detected.

Figure 10A:
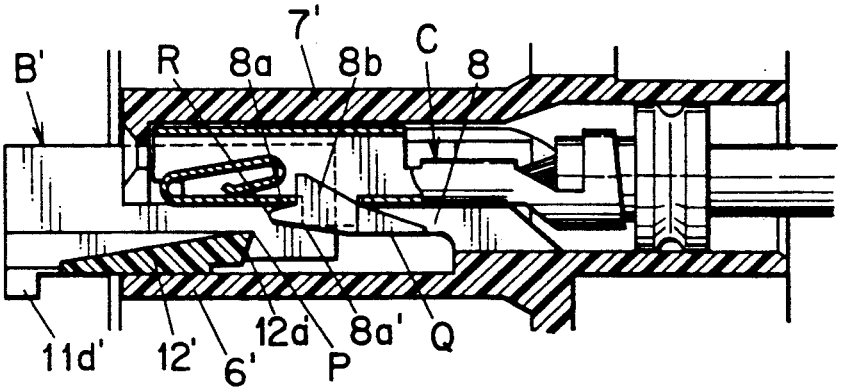
FIGS. 10A to 10D are cross sections showing a process for extracting the terminal by means of the terminal extracting block.

FIGS. 10A to 10D show a process for extracting the terminal. FIG. 10A is the same drawing as FIG. 8B which shows a preliminary locking state of the terminal extracting block B after the female terminal C is inserted. That is, after full locking condition shown in FIG. 8C, a tool like a driver is inserted from the notch 9 illustrated in FIG. 6 to extract the terminal extracting block B' by using the hitching piece 11*d*', which permits the terminal extracting piece B to be returned to the preliminary locked state. In the preliminary locking state, the point P of the arm disconnecting piece 12' is substantially flush with a bottom wall Q of the resilient locking arm 8. The point P may be positioned between the point R of a tip of the resilient locking arm 8, that is, the terminal holder 8*a* and a tip of the tapered face 8*a*' of the other side.

Figure 10B:
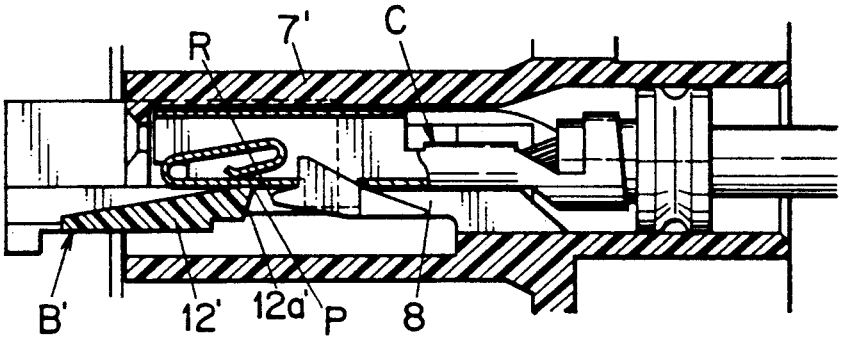

FIG. 10B shows an arm disconnecting position, which is the same condition as illustrated in FIG. 5A, in which the point P which shows a tip of the arm disconnecting piece 12 is moved higher than the point R, which is opposed to the middle of the tapered arm disconnecting face 12*a* of the arm disconnecting piece 12. In the arm disconnecting position, the positioning projections 10 engage the positioning channels 11*c*' so that the terminal extracting block B is retained at the arm disconnecting position.

Figure 10C:
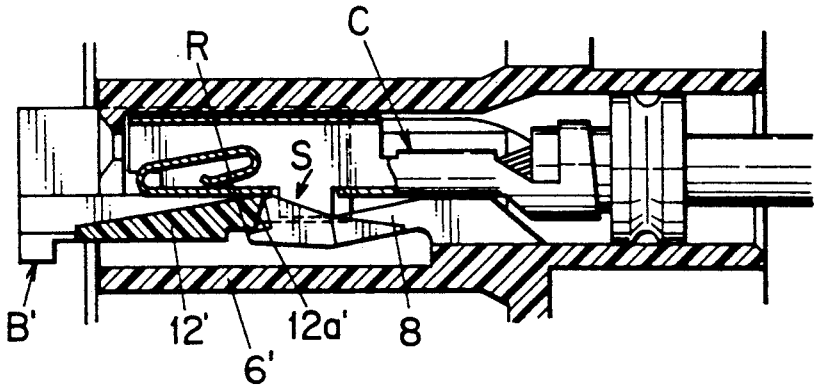
Figure 10D:
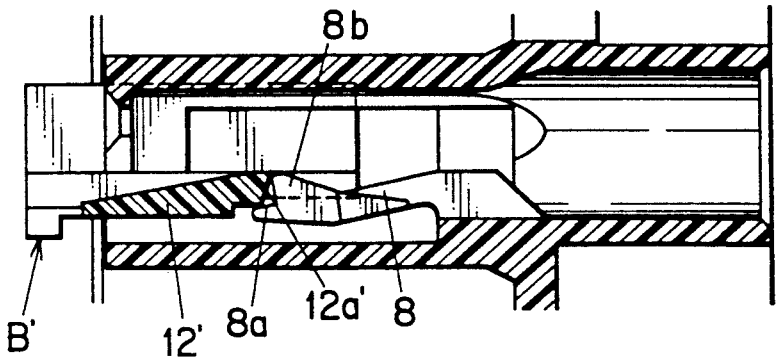
Figure 12A:
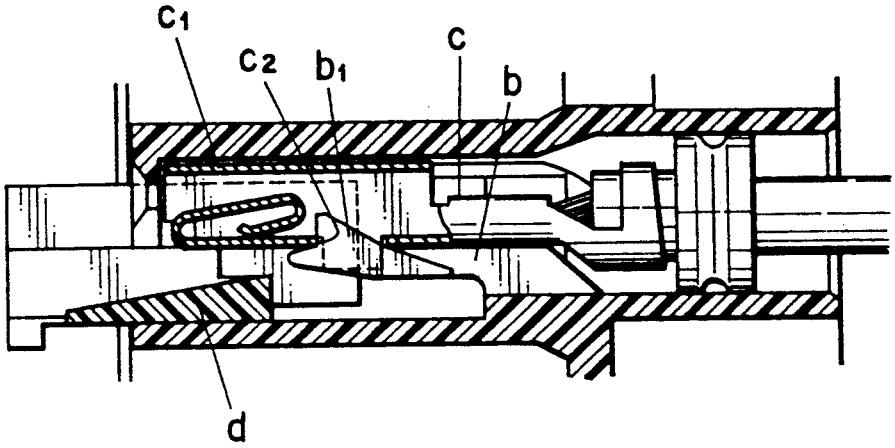
FIG. 12A PRIOR ART
FIGS. 12A and 12B are cross sections showing a process for extracting the connector of FIG. 11 having a spacer.
Figure 12B:
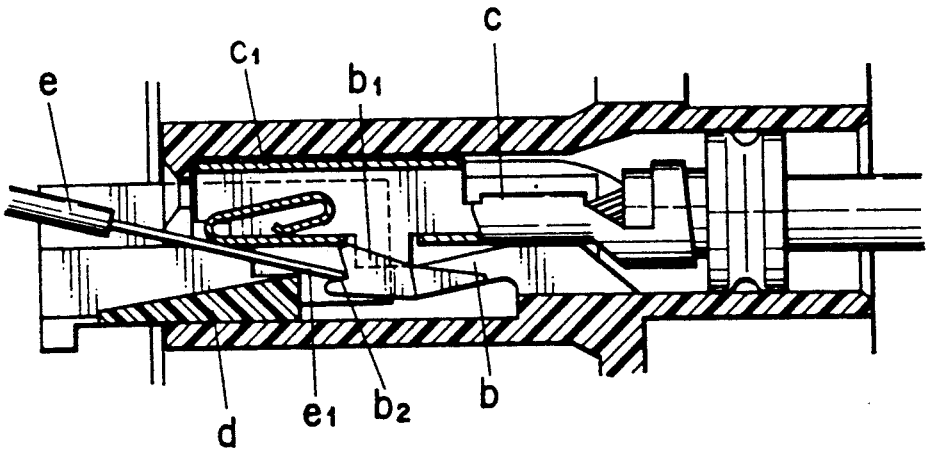
FIG. 12B PRIOR ART

FIGS. 10C and 10D show respectively a state in which the resilient locking arm 8 and the female terminal C are disconnected from each other and a condition after the terminal C is extracted. Operations to be applied to the terminal C and the resilient locking arm 8 are the same as those described in FIGS. 5B and 5C and the explanation thereof will be omitted.

As described above, according to the present invention, the connector is provided with the terminal extracting block made of synthetic resin having the arm disconnecting pieces for disconnecting the engagement with the resilient locking arm. Therefore, it is not required to used a tool for extracting the terminal and the damage to the terminal or the resilient locking arm is prevented. Further, the terminal extracting block may be made to be a little longer so that the arm disconnecting pieces proceed into the vacant space of the resilient locking arm at the full locking state to prevent the deflection of the locking arm, which increases the retaining force of the terminal and improves reliability of the electrical connection. Since the two kinds of terminal extracting blocks may be retained at fully locked condition or a preliminary condition, the handling of the terminal becomes much easier.

What is claimed is:

1. An electrical connector comprising:

a housing having terminal accommodating cavities and a resilient locking arm for preventing a terminal accommodated in said terminal accommodating cavities each from slipping off backward, said terminal accommodating cavities each having opposing inner walls, said resilient locking arm extruding from one of said inner opposing walls toward a front open end of said terminal accommodating cavities each with a vacant space being formed between said one of the opposing walls and the resilient locking arm; and a terminal extracting block having arm disconnecting pieces, said arm disconnecting pieces each having a tapered arm disconnecting face at a free end thereof, wherein said terminal extracting block moves from a locking position to an arm disconnecting position to allow said arm disconnecting face of the arm disconnecting piece to slidably contact a tip of the resilient locking arm, which causes the resilient locking arm to bend toward said one inner wall so that the terminal is disconnected from the resilient locking arm.

2. An electrical connector as claimed in claim 1, wherein side walls having an opening therebetween is provided between said opposing inner walls of said terminal accommodating cavities, and said terminal extracting block having a connecting plate, a locking plate formed at a center of the connecting plate, and a locking projection on one of side walls, said connecting plate having said arm disconnecting piece at right and left front portions each, wherein said locking plate proceeds between the side walls and the locking projection crosses over a rear end portion of one of the side walls of the terminal accommodating cavities to prevent the terminal extracting block from being slipped off backward, and a hitching piece at an end portion of the connecting plate engages a notch at a front end of the housing to lock the terminal extracting block at a locking position.

3. An electrical connector as claimed in claim 2, wherein after said terminal extracting block at the locking position is urged to an inner wall opposite to said inner wall to which said resilient locking arm is attached, said arm disconnecting face slidably contacts said tip of the resilient locking arm.

4. An electrical connector comprising:

a housing having terminal accommodating cavities and a resilient locking arm for preventing a terminal accommodated in said terminal accommodating cavities each from slipping off backward, said terminal accommodating cavities each having opposing inner walls, said resilient locking arm extruding from one of said opposing inner walls toward a front open end of said terminal accommodating cavities each with a vacant space being formed between said one of the opposing walls and the resilient locking arm; and a terminal extracting block having arm disconnecting pieces, said arm disconnecting pieces each having a tapered arm disconnecting face at a free end thereof, wherein said terminal extracting block moves from a preliminary locking position to an arm disconnecting position to allow said arm disconnecting face of the arm disconnecting piece to slidably contact a tip of the resilient locking arm, which causes the resilient locking arm to bend toward said one inner wall so that the terminal is disconnected from the resilient locking arm; and said terminal extracting block moves from the preliminary locking condition to a full locking condition to allow said arm disconnecting arm to be inserted into said vacant space between the inner wall of the terminal accomodating cavities each and the resilient locking arm, which prevents the resilient locking arm from bending toward the inner wall.

5. An electrical connector as claimed in claim 4, wherein side walls having an opening therebetween is provided between said opposing inner walls of said terminal accomodating cavities, and said terminal extracting block having a connecting plate, a locking plate formed at a center of the connecting plate, and a first locking projection on one of side walls and a second locking projection on the other side wall, said connecting plate having said arm disconnecting piece at right and left front portions each, wherein said locking plate proceeds between the side walls and said first locking projection crosses over a first side wall of the side walls of the terminal accommodating cavities and the second locking projection abuts a front end of a second side wall of the side walls of the terminal accommodating cavities to obtain said preliminary locking condition, and said locking plate further proceeds between the side walls and the second locking projection crosses over a rear end of the second side wall to prevent the terminal extracting plate from being slipped off backward and a hitching piece at an end portion of the connecting plate engages a notch at a front end of the housing to lock the terminal extracting block at a full locking position.

6. An electrical connector as claimed in claim 5, wherein after said terminal extracting block at the locking position is urged to an inner wall opposite to said inner wall to which said resilient locking arm is attached, said arm disconnecting face slidably contacts said tip of the resilient locking arm.

* * * * *